US008820366B2

(12) United States Patent
Krulitsch

(10) Patent No.: US 8,820,366 B2
(45) Date of Patent: Sep. 2, 2014

(54) FILLER ELEMENT FOR FILLING CONTAINERS WITH A LIQUID FILL MATERIAL, AND FILLING MACHINE

(75) Inventor: Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 595 days.

(21) Appl. No.: 12/919,197

(22) PCT Filed: Feb. 5, 2009

(86) PCT No.: PCT/EP2009/000782

§ 371 (c)(1), (2), (4) Date: Aug. 24, 2010

(87) PCT Pub. No.: WO2009/106215

PCT Pub. Date: Sep. 3, 2009

(65) Prior Publication Data

US 2011/0030843 A1 Feb. 10, 2011

(30) Foreign Application Priority Data

Feb. 26, 2008 (DE) ..... 10 2008 011 109

(51) Int. Cl.
*B67C 3/26* (2006.01)

(52) U.S. Cl.
CPC ..... *B67C 3/26* (2013.01); *B67C 2003/2657* (2013.01); *B67C 2003/266* (2013.01)
USPC ..... 141/371; 141/147; 141/263; 141/292; 141/368; 141/266

(58) Field of Classification Search
USPC ..... 141/292, 294, 263, 266, 181–182, 141/144–147, 46, 368, 371
See application file for complete search history.

(56) References Cited

U.S. PATENT DOCUMENTS

| | | | | | |
|---|---|---|---|---|---|
| 2,761,607 | A | * | 9/1956 | Ayars | 141/147 |
| 3,155,127 | A | | 11/1964 | Hubbard | |
| 4,674,547 | A | * | 6/1987 | Simonazzi | 141/263 |
| 4,711,276 | A | * | 12/1987 | Simonazzi | 141/286 |
| 5,063,978 | A | * | 11/1991 | Walusiak | 141/263 |
| 5,065,799 | A | * | 11/1991 | Weiss | 141/39 |
| 5,119,853 | A | * | 6/1992 | Petri et al. | 141/39 |
| 5,220,946 | A | * | 6/1993 | Murao et al. | 141/6 |
| 5,372,167 | A | * | 12/1994 | Hirose et al. | 141/39 |
| 6,038,833 | A | * | 3/2000 | Beringer | 53/253 |

FOREIGN PATENT DOCUMENTS

| | | |
|---|---|---|
| DE | 3732881 | 5/1989 |
| DE | 19545080 | 6/1997 |
| DE | 202006001234 | 3/2007 |
| EP | 0 179 976 | 5/1896 |

(Continued)

*Primary Examiner* — Timothy L Maust
*Assistant Examiner* — Timothy P Kelly
(74) *Attorney, Agent, or Firm* — Occhiuti & Rohlicek LLP

(57) ABSTRACT

The invention relates to a filling element of a filling machine for filling cans, bottles, or similar containers (2) with a liquid fill material, having at least one dispensing opening (8) for directing the liquid fill material into each container through a container opening (2.1) forming an opening edge, having at least one container contact surface (14) for the opening edge at a tulip (13, 13*a*, 13*b*) displaceable on a filling element housing (6) between a raised starting position and a lowered position, and having means for moving the tulip between the starting position and the lowered position and for pressing the tulip against the opening edge of each container with a contact pressure.

19 Claims, 6 Drawing Sheets

(56) References Cited

FOREIGN PATENT DOCUMENTS

| | | | |
|---|---|---|---|
| EP | 0 204 937 | A | 12/1986 |
| EP | 0309928 | | 4/1989 |
| EP | 0318463 | | 5/1989 |
| EP | 0 405 259 | | 1/1991 |

* cited by examiner

FILLER ELEMENT FOR FILLING CONTAINERS WITH A LIQUID FILL MATERIAL, AND FILLING MACHINE

CROSS-REFERENCE TO RELATED APPLICATIONS

This application is the National Stage of International Application No. PCT/EP2009/000782, filed on Feb. 5, 2009, which claims the benefit of German Application Serial No. 10 2008 011 109.0, filed on Feb. 26, 2008. The contents of both of the foregoing applications are hereby incorporated by reference in their entirety.

FIELD OF DISCLOSURE

The invention relates to a filler element a filling machine of the rotating type that uses the filling element.

BACKGROUND

In rotating filling machines for filling cans, the underside of a filler element has a discharge opening for the controlled discharge of the liquid product into the containers. It is usual to place a tulip there. The tulip is displaceable in the direction of the vertical filler element axis and has a container contact surface formed by at least one seal.

A tulip is moveable between a raised initial position, in which the container contact surface is situated at a spacing above the opening of each container located at the filler element, and a lowered position, in which, the container contact surface abuts in a sealed manner against the opening edge of the container surrounding the container opening.

A cam controls both this movement of the tulip between the raised and lowered positions, and the contact pressure of the tulip on the can. To implement this, each filler element has a control or lifting rod that is oriented with its longitudinal extension parallel to the filler element axis and that is guided at the filler element so as to be displaceable in this axis. The bottom end of the control or lifting rod connects to the tulip of the filler element.

A cam or control roller is mounted so as to be freely rotatable at the top end of the control or lifting rod. The cam or control roller interacts with a fixed control cam, i.e. not rotating with the rotor of the filling machine. The control or lifting rod is tensioned in a preliminary manner by spring means acting directly on the control or lifting rod and consequently the tulip is also tensioned in a preliminary manner into the raised position. Through the control cam interacting with the control roller, the control or lifting rod, and consequently also the tulip, is moved into the lowered position in opposition to the effect of the spring means.

One disadvantage, among others, is that the design of the filler elements is relatively complicated and time-consuming mechanically. The filler elements are therefore expensive and also subject to abrasive wear.

A further disadvantage is that the contact force with which the tulips of the filling machine abut against the respective container in the region of the container mouth are path-determined. The contact force can therefore change because of abrasive wear. In addition, the contact forces of different filler elements can be different from each other. This can result in a not inconsiderable impairment to the method of operation of a filling machine.

In known filling machines, it is not presently known how to regulate or adjust the contact pressure with which the tulips abut against the respective containers to be filled without spending non-justifiable amounts of money and time. It is also not known how to adapt the contact pressure to the fill pressure, which is dependent, among other things, on the liquid pressure and/or to the mechanical characteristics of the containers.

SUMMARY

It is the object of the invention to provide a filler element that avoids the aforementioned disadvantages and that, with a simplified design and a high level of operational reliability, makes it possible for optimum pressing of the container contact surface formed at the tulip against the respective container during the filling process.

A distinct feature of the invention is that the respective tulip is at the same time part of a piston-cylinder arrangement, the cylinder chamber of which can be impinged upon with the pressure of a pressure medium, preferably a compressible pressure medium, namely with the pressure of a vaporous or gaseous pressure medium, at least to generate the contact force or the contact pressure at which the container contact surface of the tulip, formed, for example, by at least one seal, is pressable against the opening or mouth edge of the respective container. In the case of a preferred embodiment of the invention, distinguished by a particularly simplified design, the respective tulips or part portion of said tulips are realized as an annular piston, which is then guided so as to be displaceable in a ring-shaped cylinder chamber.

In the case of a general implementation of the invention, the returning of the respective tulip into the raised initial position and/or the holding of the tulip in said initial position is effected mechanically or at least is at least mechanically supported, for example by means of at least one spring element acting as a return spring and/or is cam-controlled.

In the case of another general embodiment of the invention, the returning of the respective tulip into the initial position and the holding of the tulip in said initial position is effected by means of corresponding activation of the at least one cylinder chamber, for example by means of impinging upon said cylinder chamber with negative pressure.

Further developments, advantages and application possibilities of the invention proceed from both the subsequent description of exemplary embodiments and from the Figures. In this case, all described and/or graphically represented features, individually or in arbitrary combination are in principle objects of the invention, irrespective of their summary in the claims or their dependency. The content of the claims is also made a component of the description. The invention is explained below by way of the Figures of exemplary embodiments, in which:

DETAILED DESCRIPTION

Figure 1:
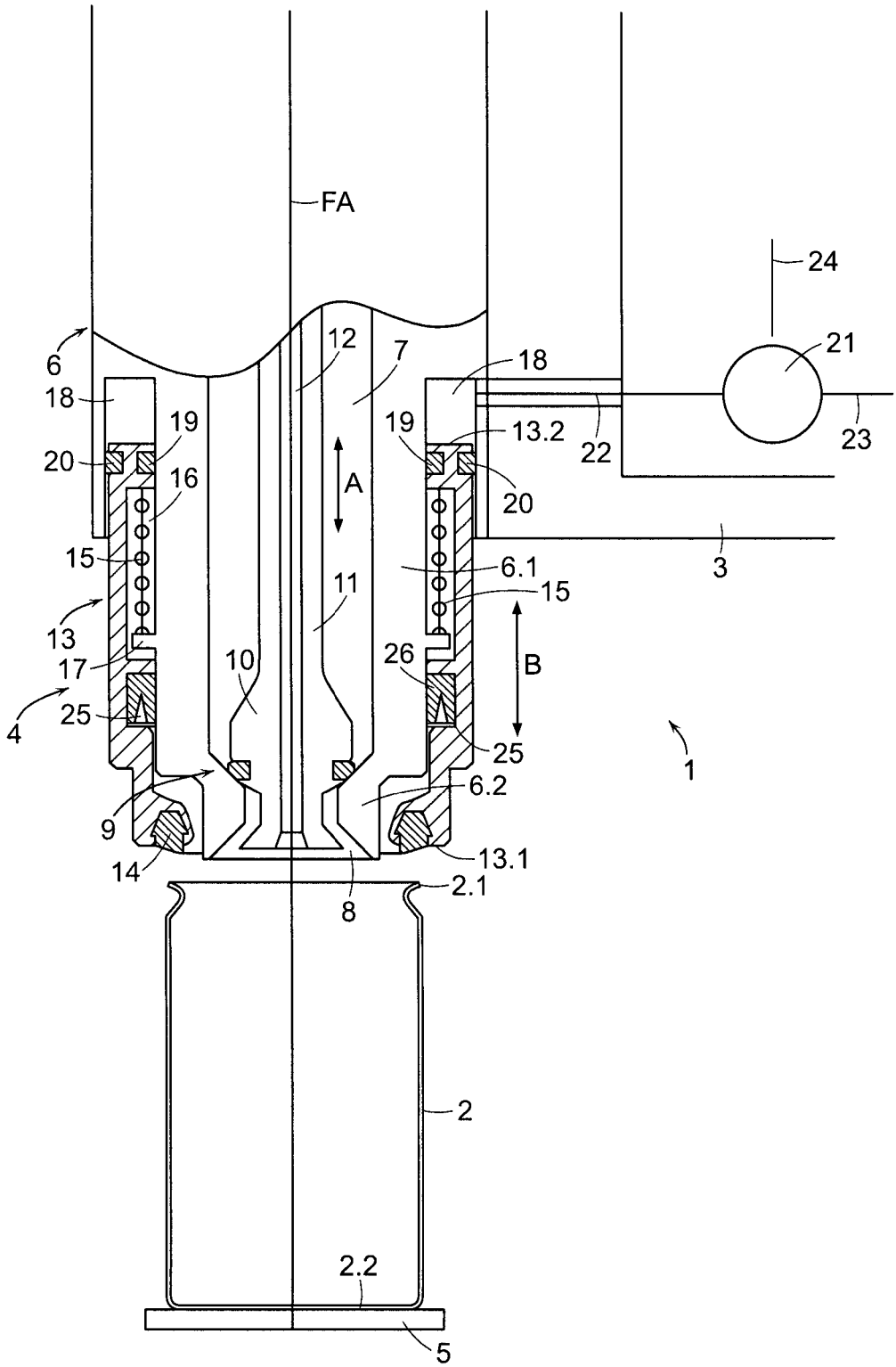
FIG. 1 is a simplified drawing of a filler element with a container located under a raised tulip.
Figure 2:
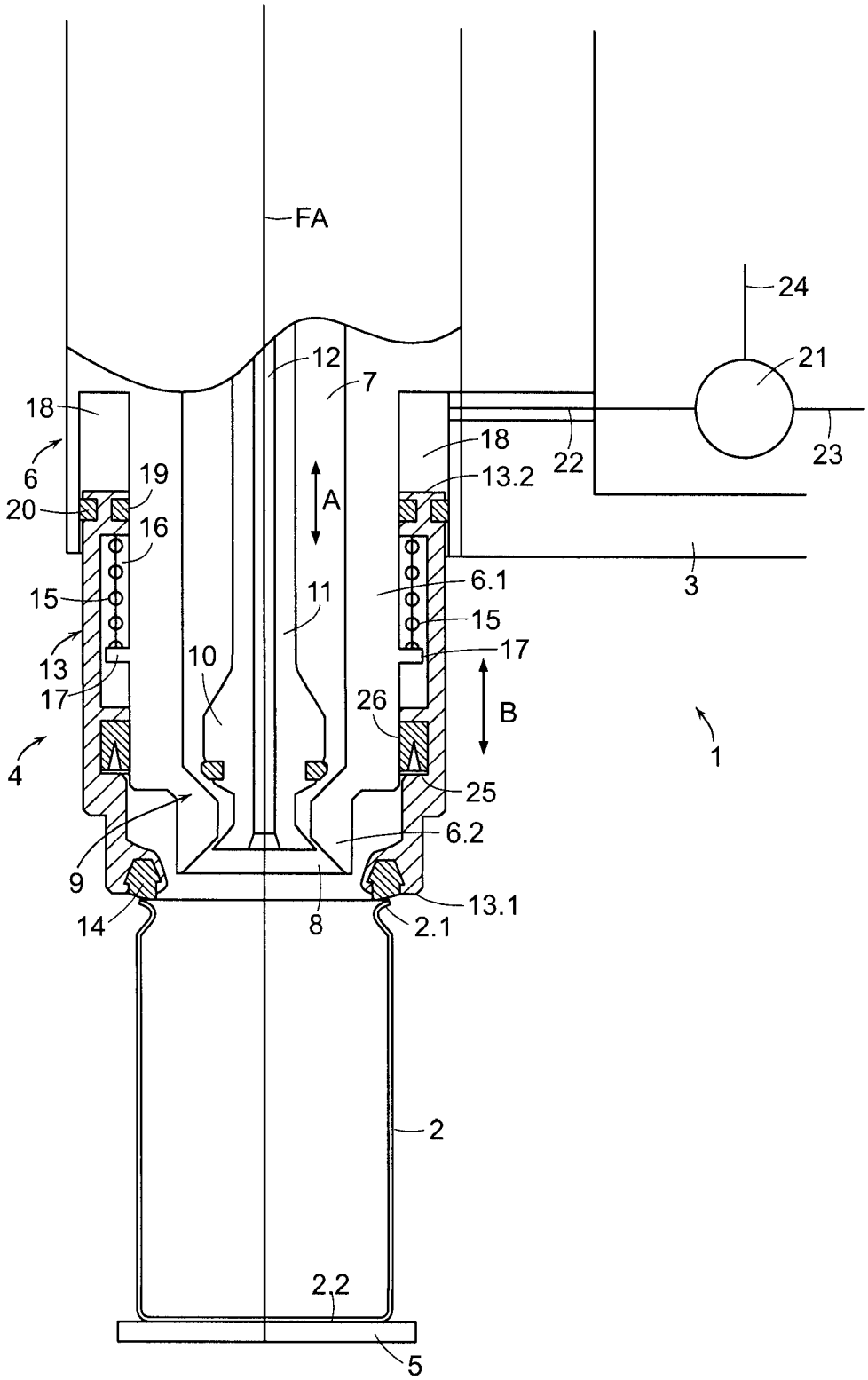
FIG. 2 shows the filler element of FIG. 1 with the tulip lowered into the sealing position.

FIGS. 1 and 2 each show a fill station 1 of a filling machine of the rotating type for the filling, for example pressure filling, of containers in the form of cans 2 with a liquid product.

The fill station 1, which is located together with a plurality of identical type fill stations on the periphery of a rotor 3 that can be driven in a rotating manner about a vertical machine axis, essentially comprises a filler element 4 provided on the periphery of the rotor 3, and a container carrier 5 provided below the filler element 4. The can 2 to be filled stands upright on the container carrier 5 with its can axis in the vertical direction, with the can's opening 2.1 facing upward, and with the can bottom 2.2 standing on the container carrier 5, which is realized as a plate.

A liquid channel 7 passes through a housing 6 of the filler element 4 in a known manner. The liquid channel communicates with a tank (not represented) that is provided at the rotor 3 via a liquid connection (not represented either). The tank is filled during the filling process with the liquid product that is ultimately to be filled into the cans 2 and from which the liquid product is supplied to the individual filler elements 4, as is known to the expert of filling machines of the rotating type.

On the underside of the filler element 4, facing the container carrier 5, is a discharge opening 8. A controlled liquid valve 9 is provided in the liquid channel 7 at the discharge opening 8 for controlled release of liquid product into the can 2. The liquid valve has a valve body 10 that interacts with a valve seat. The valve body is formed on a valve plunger 11. As indicated by the double arrow A, the valve plunger 11 is moveable up and down in the direction of the vertical filler element axis FA in a controlled manner for opening and closing the liquid valve 9. FIG. 1 shows the liquid valve 9 in its closed state. FIG. 2 shows the liquid valve 9 in its open state.

An open gas channel 12 is also realized in the valve plunger 11 at its bottom end. This gas channel 12 is a component of a controlled gas path.

The housing 6 is a circular cylinder that is concentric with the axis FA. The discharge opening 8 is formed at a bottom housing portion 6.2 of this housing 6. A tulip 13 extends between the bottom housing portion 6.2 and a middle housing portion 6.1 of the housing 6. The tulip 13 is displaceable in the direction of the filler element axis FA by a predetermined travel, as shown by the double arrow B.

In the illustrated embodiment, the tulip 13 is substantially ring-shaped or sleeve-shaped. The tulip 13, for this reason, is provided with a ring seal 14 at a bottom open end 13.1 thereof or at an end face at the bottom open end 13.1. With the tulip raised, as shown in FIG. 1, the ring seal 14 surrounds but is spaced from the bottom portion 6.2 of the housing 6, which is where the discharge opening 8 is. As shown in FIG. 2, the ring seal 14 forms a container contact surface when the tulip 13 abuts against the edge of the can opening 2.1 in a sealing position.

A compression spring 15 surrounds the middle housing portion 6.1. This compression spring 15 biases the tulip 13 into the raised initial position represented in FIG. 1. In this raised initial position, the bottom open end 13.1 of the tulip 13 is spaced apart from the can 2 or from the edge of the can opening 2.1 in the vertical direction. Thus, the bottom open end 13.1 is situated above the can opening 2.1.

A ring-shaped recess 16 in the tulip 13 accommodates the compression spring 15. Upper and lower horizontal walls define the recess 16. The upper horizontal wall of the recess 16 supports a top end of the compression spring 15. A flange or collar 17 protrudes from the middle housing portion 6.1 into the recess 16. This collar 17 supports a bottom end of the compression spring 15. At the same time, the collar 17 serves as a stop member that limits upward movement of the tulip 13. In doing so, the collar 17 interacts with the lower horizontal wall that defines the recess 16.

A distinct feature of the filler element 4 is that the tulip 13 defines an annular piston having a top end 13.2 that extends into a ring-shaped cylinder chamber 18 in the housing 6. An inner piston seal 19 and an outer piston seal 20 sealingly guide the top end 13.2 as the tulip 13 moves axially in the cylinder chamber 18, i.e. in the direction of the axis FA. The two piston seals 19, 20 surround the axis FA in a concentric manner.

A control channel 22 realized with a valve arrangement 21 opens out into the cylinder chamber 18. Using the control channel 22 and the valve arrangement 21, it is possible to fill the cylinder chamber 18 with a pressure medium. Preferably, the pressure medium is a compressible pressure medium, such as compressed air, and preferably, sterile compressed air. The pressure medium applies a force that urges the tulip 13 downward, in opposition to the upward force exerted by the compression spring 15. The pressure medium thus causes the tulip 13 to move out of the raised position and into the lowered position and for pressing the tulip 13 with the ring seal against the mouth edge of a can 2 to be filled. In addition, a controlled relieving or ventilating of the cylinder chamber 18 is possible via the control valve arrangement 21 so that at the end of the respective filling process, the spring 15 moves the tulip 13 back into its raised initial position.

The control valve arrangement 21, is formed by a three/two-way valve or corresponds with regard to its function to a three/two-way valve. In a first state of the arrangement 21, the cylinder chamber 18 connects via a first line 23 to a source for the pressure medium. In a second state of the arrangement 21, the cylinder chamber 18 connects to a ventilating line 24. The ventilating line 24 can connect to a vacuum or negative pressure line.

The tulip 13 of each filler element 4 or the tulips 13 of a smaller group of filler elements 4 are individually controllable via the control valve arrangement 21. To this end, the control valve arrangement 21 is thus provided individually on the rotor 3 for each filler element 4 or for a smaller group of filler elements.

The valve arrangement 21, or the three/two-way valve, for example forming said valve arrangement, is developed such that it can be actuated by a central control device of the filling machine. In one embodiment, the control device is a computer.

In order to avoid entry of liquid product into a gap formed between the outside surface of the middle housing portion 6.1 and the inside surface of the tulip 13, and in particular, to avoid entry of liquid product into the recess 16, a sealing ring 26 is provided on the inside surface of the tulip 13 below the recess 16 in an annular groove 25 concentric with the axis FA. The sealing ring abuts the outside surface of the middle housing housing portion 6.1. In the illustrated embodiment, the sealing ring 26 is a lip seal.

A process for filling cans using the filler element 4 begins with a can 2 to be filled being positioned onto the container carrier 5 of the fill station 1 in such a way that the axis of the can 2 is located on along the axis FA. At this point, there is no pressure medium in the cylinder chamber 18. The spring 15 raises the tulip 13 into its raised position and the liquid valve 9 is closed, as shown in FIG. 1.

With the liquid valve 9 still closed, the valve arrangement 21 operates to allow pressure medium to enter the cylinder chamber 18. As a result, the tulip 13 moves downward in the direction of the axis FA such that the ring seal 14 comes to rest against the opening edge of the can 2 that is standing on the container carrier 5. The truncated cone-shape of the bottom tulip end 13.1 and the ring seal 14 cooperate to align the can 2 relative to the filler element 4.

With the cylinder chamber 18 still exposed to the pressure medium, the can 2 is pre-pressurized to fill pressure and then subsequently filled with the liquid product by opening the liquid valve 9. The pressure in the cylinder chamber 18, and consequently also the contact pressure of the ring seal 14 against the opening edge of the respective can 2, is maintained via the pressure line 23 and the valve arrangement 21 up to the end of the respective filling process.

At the end of the process, the cylinder chamber 18 is ventilated through corresponding actuation of the valve arrangement 21. This is carried out by connecting the ventilating line 24 until the pressure in the filled can 2 is relieved to atmospheric pressure. Pressure relief can occur via a controlled gas channel of the filler element 4.

Advantages of the filler element 4 include its simplified structural, the simplicity of adapting the contact pressure of the tulip 13 against can 2, the ease with which contact pressure can be adapted as a function of fill pressure, the ability to avoid having the tulip mechanically overload and possibly deform a can 2 as a result of excessive contact pressure; the possibility of adapting and optimizing the contact pressure for adaptation to the mechanical characteristics of the cans 2; and the reduction of the mass to be moved during actuation, i.e. when raising and lowering the tulips 13.

A further substantial advantage of the filler element 4 is also that the contact force or the contact pressure are not path-controlled or path-determined. Consequently, during the filling process, it is possible to achieve an optimum sealing position at each filler element 4 independently of variations between filler elements that may have been caused by the production process and/or by abrasive wear.

Figure 3:
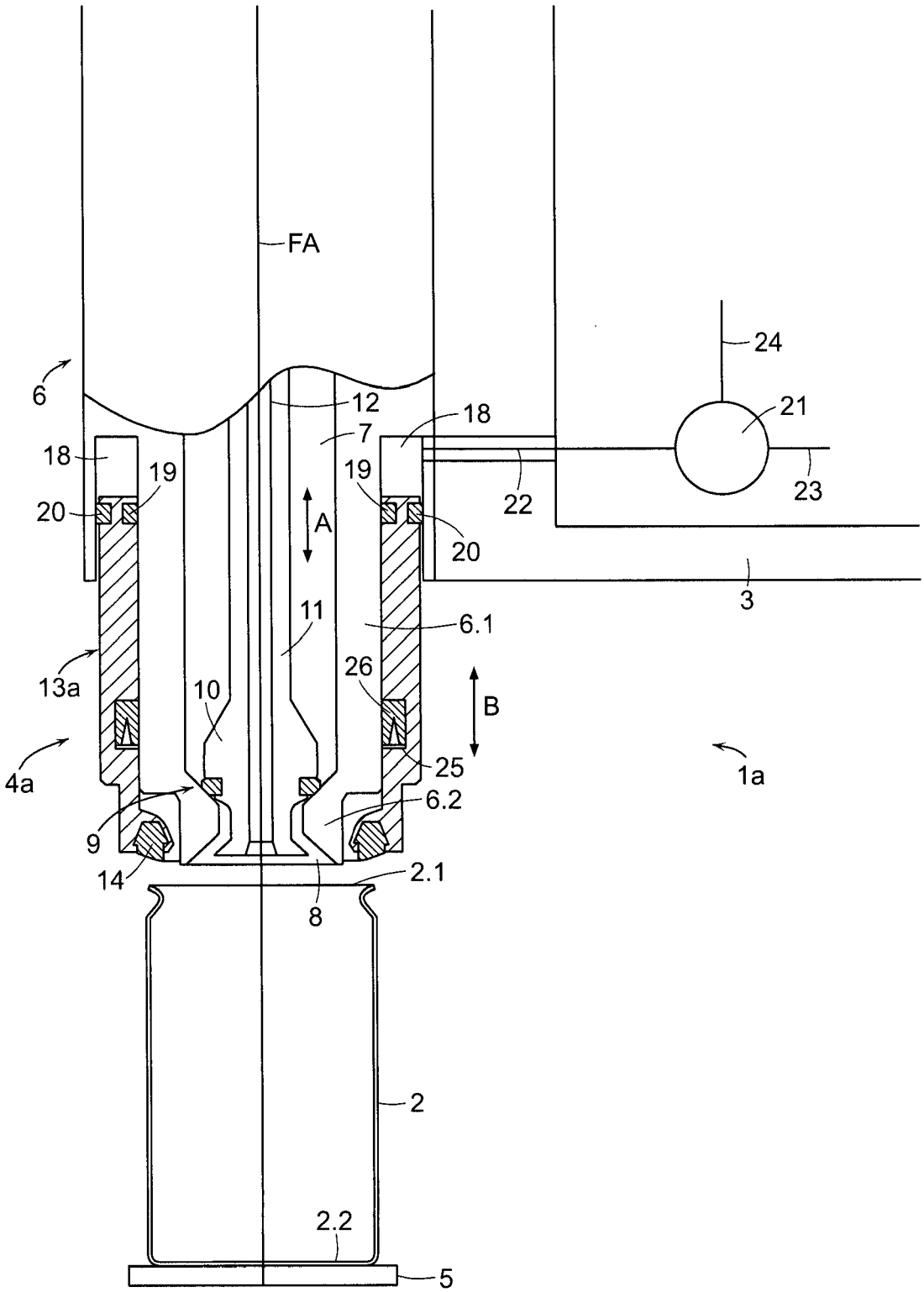
FIG. 3 shows an alternative embodiment of a filler element with the tulip in the raised position.
Figure 4:
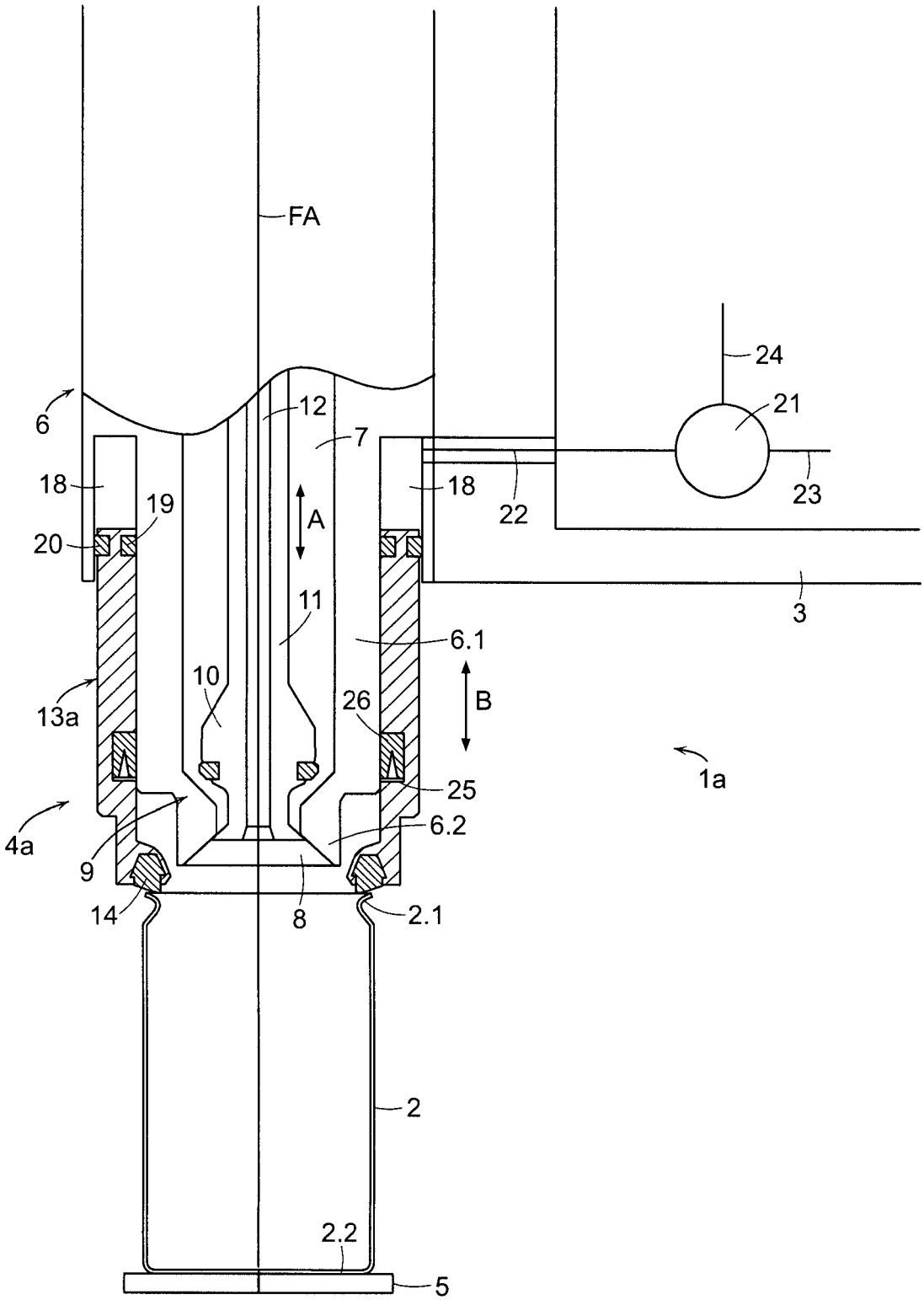
FIG. 4 shows the filler element of FIG. 3 with the tulip in the sealing position.

FIGS. 3 and 4 show a fill station 1*a* that is similar to the fill station 1 shown in FIGS. 1 and 2 with the only substantial difference being that the force urging the tulip 13*a* into the raised initial position and that holds the tulip 13*a* in this initial position does not come from a return spring. Instead this force arises by exposing the cylinder chamber 18 to a source of vacuum or negative pressure. The line 24 is connected for this purpose to a vacuum or negative pressure source common to all filler elements 4*a* of the filling machine.

To raise the tulip 13*a*, the cylinder chamber 13 is connected to the line 24 via the valve arrangement 21. This connection is maintained as long as the tulip 31*a* is in the raised state.

To lower the tulip 13*a* and to press the ring seal 14 against the mouth edge of the can located on the container carrier 5, the cylinder chamber 18 is exposed to pressure by corresponding actuation of the valve arrangement 21, by connecting the chamber 18 to the pressure line 23.

The fill station 1*a* or of the filler element 4*a* thus avoids the need for the compression spring 15. This avoids the need for space for accommodating the compression spring. An advantage of avoiding the need for this space is that such a space is difficult to access, and therefore difficult to clean.

Figure 5:
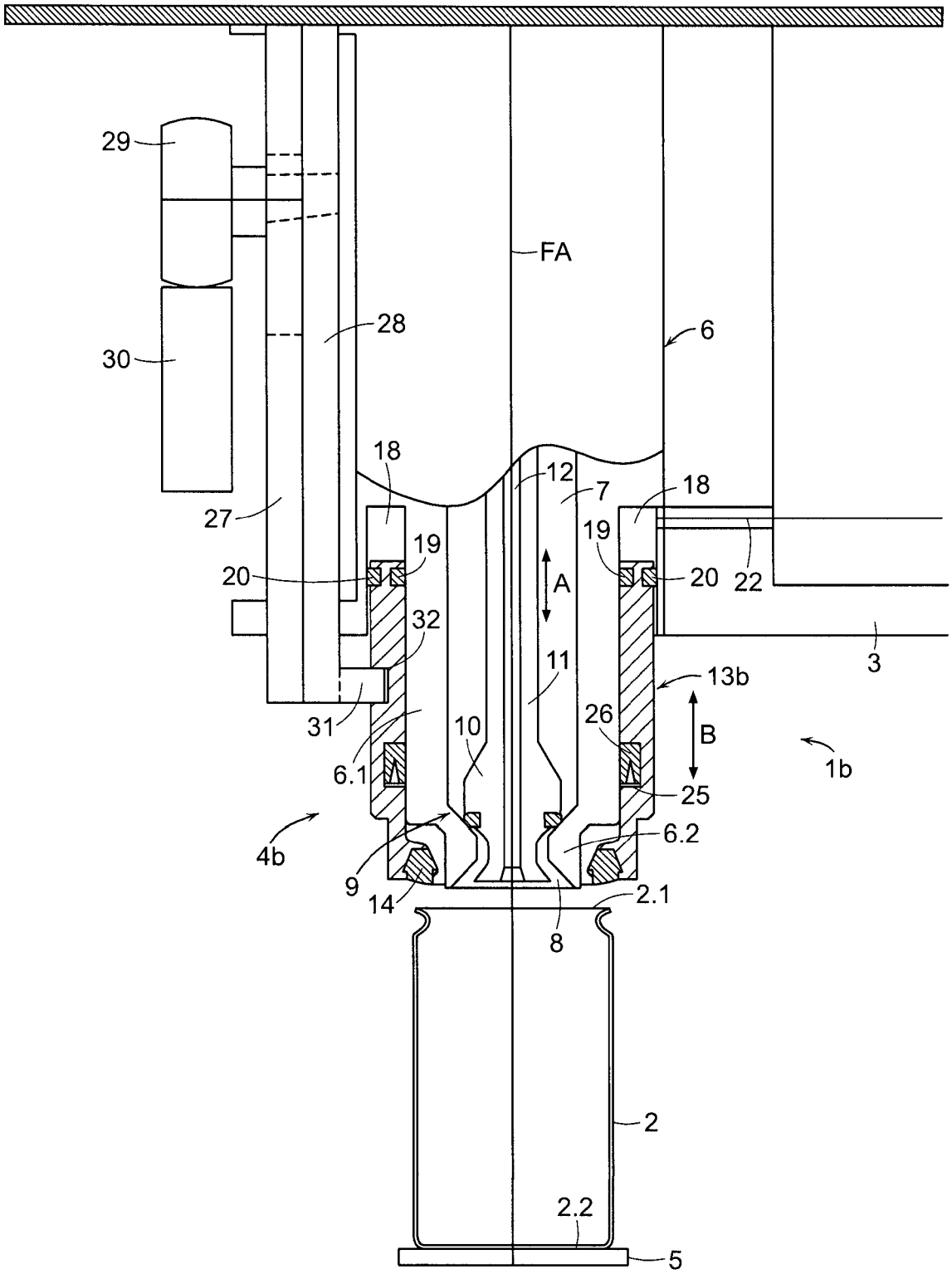
FIG. 5 shows yet another embodiment of a filler element with the tulip in the raised position.
Figure 6:
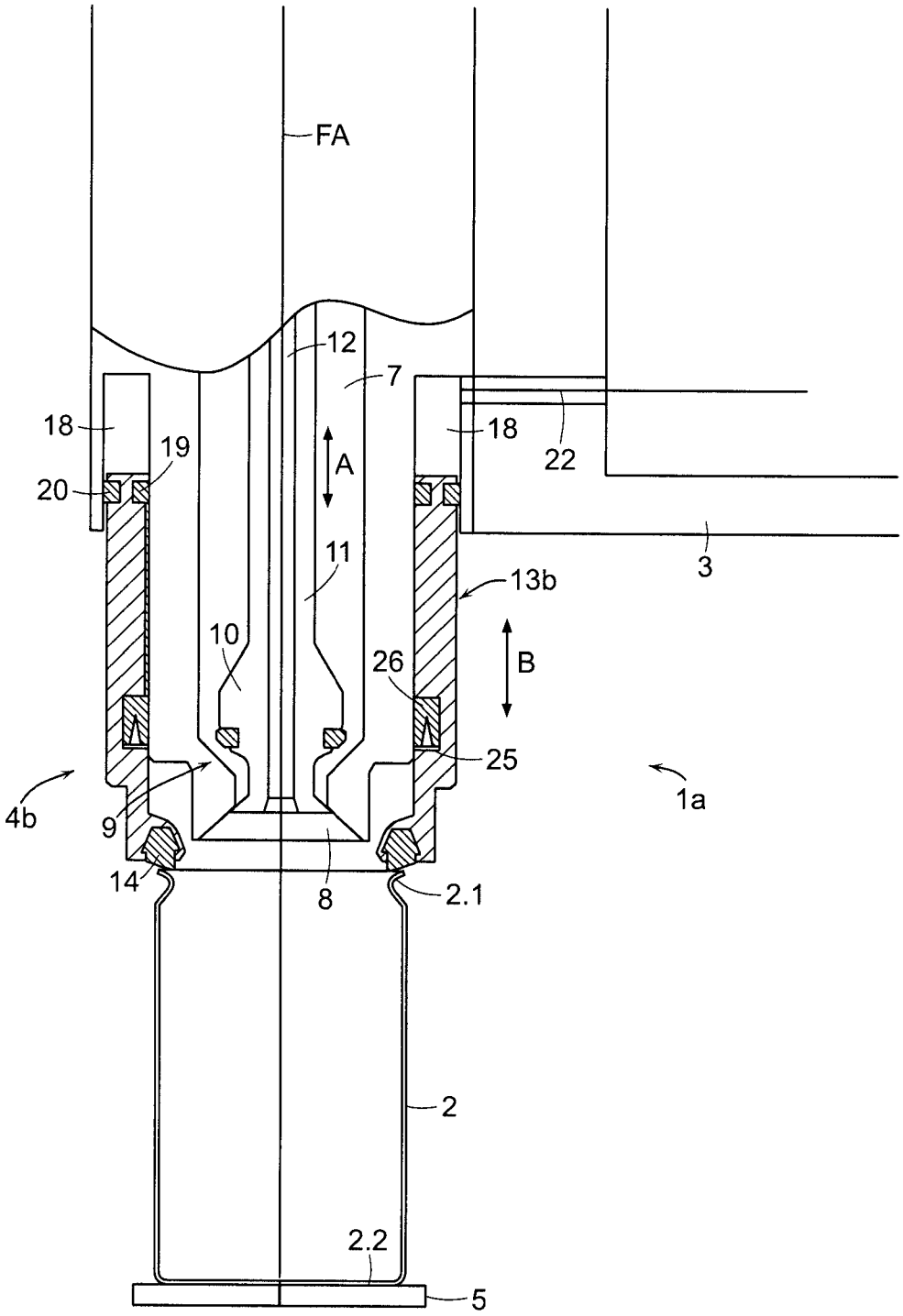
FIG. 6 shows the filler element of FIG. 5 with the tulip in the sealing position.

A further embodiment of a fill station 1*b*, shown in FIGS. 5 and 6, uses a cam-controlled mechanical system for returning and holding of the tulip 13*b*. To this end, each filler element has a rod 28 that is oriented with its longitudinal extension parallel to the axis FA and is guided so as to be displaceable in the longitudinal direction at the filler element 4*b* or at a plate or guide 27 at that location.

The rod 28 has a freely rotatably mounted control roller 29 in the region of its top end. The control roller 29 interacts with a fixed control cam 30, which is a control cam that does not rotate with the rotor 3. The bottom end of the rod 28 is connected to drive the tulip 13*b* via a journal 31 that engages in a recess 32 provided on the outside of said tulip. As a result, using the control roller 29 and the control cam 30 or through the development of said control cam, it is possible to move the tulip 13*b* into its raised initial position and to hold the tulip 13*b* in its raised initial position.

In this embodiment, the force for pressing the tulip 13*b* or the ring seal 14 against the mouth edge of a respective can 2 standing on the container carrier 5 arises from exposing a cylinder chamber 18 to pressure of a pressure medium. The control cam 30 has a development such that when the fill element is in the angular region of the rotational movement of the rotor 3 about the vertical machine axis at which the tulip 13*b* is to be lowered and pressed against the can 2 the development enables the lowering of the tulip 13*b*.

As the movement of the tulip 13*b* into the raised initial position and the holding of the tulip 13*b* in the initial position is effected mechanically, i.e. in a cam-controlled manner, it is possible to expose the cylinder chambers 18 of all the filler elements 4*b* constantly with the pressure medium. This means the valve arrangements 21 is no longer needed. This further reduces cost of the filling machine.

Regardless of this, however, the pressure in the cylinder chambers 18 is adjustable and/or regulatable such that the pressure, in its turn, can be adapted in an optimum manner to the respective fill pressure and/or to the mechanical characteristics of the cans 2.

The invention has been described above by way of exemplary embodiments. It is obvious that modifications and conversions are possible without departing from the inventive concept underlying the invention.

Thus the invention has been described in the context of rotating filling machines for filling cans 2. Obviously the embodiment according to the invention with corresponding adaptation of the respective tulips 13, 13 or 13*b* is also suitable for the filling of other types of containers, for example for the filling of bottles or bottle-like containers. Also in the case of filling machines of this type, the sealing position for the respective container at the filler element is achieved by means of a tulip, which is provided so as to be moveable in the direction of the filler element axis and has the seal pressed against the container mouth, in that said tulip is a piston-cylinder arrangement that can be impinged upon with pressure.

It has also been assumed above that the container carriers 5 form standing surfaces for the container or cans 2 to be filled. Other container carriers are obviously also possible, for example such as those in which container to be filled is suspended, for example, at a container flange that is formed in the region of the container mouth.

LIST OF REFERENCES

1, 1*a*, 1*b* Fill station
2 Can
2.1 Can opening or can mouth
2.2 Can bottom
3 Rotor
4, 4*a*, 4*b* Filler element
5 Container carrier
6 Housing
6.1, Middle housing portion
6.2 Lower housing portion
7 Liquid channel
8 Discharge opening
9 Liquid valve

10 Valve body
11 Valve plunger
12 Gas channel
13, 13*a*, 13*b* Tulip
13.1 Bottom end of the tulip
13.2 Top end of the tulip
14 Ring seal
15 Compression spring
16 Recess
17 Collar-like or flange-like portion
18 Cylinder chamber
19, 20 Seal
21 Valve arrangement
22 Control channel
23 Pressure line
24 Ventilating or negative pressure line
25 Annular groove
26 Seal
27 Plate
28 Control rod
29 Control roller
30 Control cam
31 Journal
32 Recess
A Travel movement of the valve plunger 11
B Travel movement of the tulip 13, 14*a* or 13*b*
C Travel movement of the control rod 28
FA Filler element axis

The invention claimed is:

1. An apparatus for filling containers, including cans and bottles, with a liquid product, wherein said container has an opening surrounded by an opening edge, said apparatus comprising a filler element, said filler element comprising a filler element housing, a discharge opening, a container contact surface, a tulip, a cylinder, a chamber, a source of pressure connected to said chamber, wherein said chamber is disposed within said cylinder, wherein a wall of said chamber is defined by an upper surface of said tulip, wherein said tulip defines a piston that is guided for movement in said cylinder, wherein said piston extends between said container contact surface and said upper surface, wherein a total gas pressure acting on said tulip is a sum of pressure from said source of pressure in said chamber and ambient air pressure, where said discharge opening is disposed for controlled introduction of said liquid product into said container, wherein said container contact surface is disposed at a bottom of said tulip, wherein said tulip is movable relative to said housing between a raised position and a lowered position, wherein a force generated by said pressure in said chamber causes said tulip to transition into said lowered position, wherein a value of said pressure controls contact pressure against an opening edge of a container, and wherein the tulip is guided so as to be displaceable with a part region in the cylinder chamber.

2. The apparatus of claim 1, wherein said tulip defines an annular piston, wherein said chamber is an annular chamber, and wherein said annular piston is movable in said annular chamber in an axial direction.

3. The apparatus of claim 1, wherein said source of pressure that is lower than ambient air pressure for moving said piston into said raised position.

4. The apparatus of claim 3, wherein said chamber is connected to a vacuum for moving said tulip into said raised position.

5. The apparatus of claim 1, further comprising a cam control system coupled to said tulip, wherein said cam is configured to raise said tulip into said raised position.

6. The apparatus of claim 5, wherein said cam control system comprises a control roller and a control cam that interacts with said control roller, and wherein said control roller is coupled to said tulip so that said control cam causes said tulip to transition between said raised and lowered positions thereof.

7. The apparatus of claim 1, further comprising a spring for urging said tulip to be in said raised position.

8. The apparatus of claim 7, wherein said tulip comprises a recess sized to accommodate said spring.

9. The apparatus of claim 1, further comprising a control system for controlling pressure of said pressure medium in said chamber.

10. The apparatus of claim 9, wherein said control system is configured to control said pressure as a function of a fill pressure of said container.

11. The apparatus of claim 9, wherein said control system is configured to control said pressure to avoid mechanical overload of said container.

12. The apparatus of claim 9, wherein said control system is configured to control said pressure to avoid deformation of said container.

13. The apparatus of claim 1, further comprising a controllable valve arrangement, wherein said controllable valve arrangement connects said cylinder chamber to said source of pressure.

14. The apparatus of claim 1, further comprising a controllable valve arrangement, and a ventilating line, wherein said controllable valve arrangement is configured to selectively cause said chamber to be connected to said ventilating line.

15. The apparatus of claim 1, further comprising a controllable valve arrangement, and a vacuum line, wherein said controllable valve arrangement is configured to selectively cause said chamber to be connected to said vacuum line.

16. The apparatus of claim 1, wherein said chamber is selectively connectible to said source of pressure via a three/two-way valve.

17. The apparatus of claim 1, further comprising a filling machine, wherein said filler element comprises one of a plurality of filler elements in said filling machine.

18. The apparatus of claim 17, wherein said filler elements are divided into at least a first filler element group and a second filler element group, wherein said first filler element group comprises at least one filler element, said apparatus further comprising a control system, a first controllable valve arrangement, and a second controllable valve arrangement, wherein said first controllable valve arrangement corresponds to said first filler element group and said second controllable valve arrangement corresponds to said second filler element group, wherein said control system controls operation of said first controllable valve arrangement independently of operation of said second controllable valve arrangement.

19. The apparatus of claim 18, wherein a filler element in said first filler element group has a chamber maintained at a first pressure, wherein a filler element in said second filler element group has a chamber maintained at a second pressure, and wherein said first pressure is different from said second pressure.

* * * * *